US008928712B2

(12) United States Patent
Tandon

(10) Patent No.: US 8,928,712 B2
(45) Date of Patent: Jan. 6, 2015

(54) SYSTEMS AND METHODS FOR CONTROLLING TENSION IN A RIBBON SPOOLING ASSEMBLY

(75) Inventor: Amit Tandon, Carson, CA (US)

(73) Assignee: Magtek, Inc., Seal Beach, CA (US)

( * ) Notice: Subject to any disclaimer, the term of this patent is extended or adjusted under 35 U.S.C. 154(b) by 640 days.

(21) Appl. No.: 13/188,066

(22) Filed: Jul. 21, 2011

(65) Prior Publication Data

US 2012/0027492 A1 Feb. 2, 2012

Related U.S. Application Data

(60) Provisional application No. 61/368,993, filed on Jul. 29, 2010.

(51) Int. Cl.

| | |
|---|---|
| ***B41J 32/00*** | (2006.01) |
| ***B41J 35/08*** | (2006.01) |
| *B41J 33/12* | (2006.01) |
| *B41J 33/52* | (2006.01) |
| *B41J 13/12* | (2006.01) |

(52) U.S. Cl.

CPC *B41J 35/08* (2013.01); *B41J 32/00* (2013.01); *B41J 33/12* (2013.01); *B41J 33/52* (2013.01); *B41J 13/12* (2013.01)

USPC ..... 347/214

(58) Field of Classification Search

CPC ..... B41J 17/32; B41J 2/325; B41J 32/00; B41J 2/305; B41J 31/00–35/00; B41J 25/10; B41J 29/18; B41J 33/003; B41J 33/12; B41J 33/14; B41J 33/16; B41J 33/18; B41J 33/20; B41J 33/30; B41J 35/08

USPC ..... 347/214; 400/618; 242/345.1, 421

See application file for complete search history.

(56) References Cited

U.S. PATENT DOCUMENTS 3,554,349 A 1/1971 Hebert
4,079,899 A * 3/1978 Vogel ..... 242/352.3

(Continued)

FOREIGN PATENT DOCUMENTS

JP 63312877 A * 12/1988 ..... B41J 32/00
JP 63312878 A * 12/1988 ..... B41J 32/00

(Continued)

OTHER PUBLICATIONS

IBM Technical Disclosure Bulletin, Nov. 1979, vol. 22, Issue 6, pp. 2327-2329.*

(Continued)

*Primary Examiner* — Laura Martin
*Assistant Examiner* — Jeremy Bishop
(74) *Attorney, Agent, or Firm* — Loza & Loza, LLP; Gabriel Fitch

(57) ABSTRACT

Systems and methods for controlling tension in a ribbon spooling assembly are provided. In one embodiment, the invention relates to a ribbon tension control assembly for maintaining substantially constant tension in a ribbon, the assembly including a payout core having a cylindrical shape, a first ribbon spool mounted on the payout core and attached thereto, a second ribbon spool mounted on the payout core, the second ribbon spool configured to move independent from the payout core, a takeup core configured to receive a ribbon from each of the first ribbon spool and second ribbon spool, and a load applicator configured to limit movement of the second ribbon spool.

19 Claims, 12 Drawing Sheets

(56) References Cited

U.S. PATENT DOCUMENTS

| | | | | |
|---|---|---|---|---|
| 4,343,837 | A | 8/1982 | DeLorenzo | |
| 4,573,645 | A | 3/1986 | Harris, Jr. | |
| 4,606,662 | A * | 8/1986 | Komplin | 400/214 |
| 5,486,057 | A | 1/1996 | Skinner et al. | |
| 5,653,397 | A * | 8/1997 | Park | 242/355.1 |
| 6,250,825 | B1 | 6/2001 | Kazo et al. | |
| 6,899,478 | B1 | 5/2005 | Mucelli et al. | |
| 7,150,572 | B2 * | 12/2006 | McNestry et al. | 400/223 |
| 7,234,884 | B1 * | 6/2007 | Tratar | 400/139 |
| 7,349,002 | B2 * | 3/2008 | Kanemaru et al. | 347/171 |
| 7,626,604 | B2 * | 12/2009 | Ihara | 347/213 |
| 7,963,438 | B2 * | 6/2011 | Brown et al. | 235/380 |
| 8,529,050 | B2 * | 9/2013 | Vandermeulen | 347/101 |
| 2007/0228158 | A1 | 10/2007 | Brown et al. | |
| 2008/0219744 | A1 * | 9/2008 | Valverde et al. | 400/234 |

FOREIGN PATENT DOCUMENTS

| | | | | |
|---|---|---|---|---|
| JP | 04189583 | A * | 7/1992 | B41J 35/22 |
| JP | 2005313528 | A * | 11/2005 | B41J 31/16 |

OTHER PUBLICATIONS

IBM Technical Disclosure Bulletin, Sep. 1980, vol. 23, Issue 4, pp. 1517-1520.*

IBM Technical Disclosure Bulletin, Jun. 1983, vol. 26, Issue 1, pp. 292-293, 299-300.*

IBM Technical Disclosure Bulletin, Jan. 1985, vol. 27, Issue 8, pp. 5018.* https://sdp-si.com/ss/PDF/79005059.pdf, "Sinch Roller Clutches Technical", downloaded Jun. 21, 2010, 2 pages.

* cited by examiner

SYSTEMS AND METHODS FOR CONTROLLING TENSION IN A RIBBON SPOOLING ASSEMBLY

CROSS-REFERENCE TO RELATED APPLICATION(S)

The present application claims priority to and the benefit of Provisional Application No. 61/368,993, filed Jul. 29, 2010, entitled "SYSTEMS AND METHODS FOR CONTROLLING TENSION IN A RIBBON SPOOLING ASSEMBLY", the entire content of which is incorporated herein by reference.

FIELD OF THE INVENTION

The present invention relates generally to ribbon spooling systems, and more specifically to systems and methods for controlling tension in a ribbon spooling assembly.

BACKGROUND

Ribbon spooling systems are used for a wide variety of applications, including, for example, credit card printing systems and other systems. In particular applications, it may be beneficial for the ribbon spooling systems to use more than one ribbon spool mounted on a payout core/reel that dispenses the ribbons to a takeup core/reel. However, a number of challenges are presented with the use of two or more ribbon spools. Differences in the initial diameter of the ribbons on the spools or in the thicknesses of the ribbon materials can cause problems in maintaining a constant tension in both ribbons due to unequal payout of ribbon materials. Such problems become more apparent when considering the cumulative effects of the differences in diameter and/or ribbon thickness. Ultimately, a conventional payout reel rotating both of the unequal ribbon spools will cause a lack of tension in one of the ribbons.

Proper ribbon tension in tape and ribbon spooling systems can be important. For example, in an impact printer with a moving print head having an inked ribbon suspended between the print head and a record medium (such as paper or card stock) by two guides (located on either side of the printer), the ribbon generally needs to be suspended at a proper constant tension. Insufficient ribbon tension may result in sloppy and inaccurate printing to the record medium and other printer malfunctions. Excessive ribbon tension, on the other hand, can cause stalling of the ribbon take-up spool, curling or improper winding of the ribbon onto the take-up spool, or breakage of the ribbon. As such, improved systems and methods for controlling tension in a ribbon spooling assembly would be beneficial.

SUMMARY

Aspects of the invention relate to systems and methods for controlling tension in a ribbon spooling assembly. In one embodiment, the invention relates to a ribbon tension control assembly for maintaining substantially constant tension in a ribbon, the assembly including a payout core having a cylindrical shape, a first ribbon spool mounted on the payout core and attached thereto, a second ribbon spool mounted on the payout core, the second ribbon spool configured to move independent from the payout core, a takeup core configured to receive a ribbon from each of the first ribbon spool and second ribbon spool, and a load applicator configured to limit movement of the second ribbon spool.

In another embodiment, the invention relates to a ribbon tension control assembly for maintaining substantially constant tension in a ribbon, the assembly including a payout core having a cylindrical shape, a first ribbon spool mounted on the payout core and attached thereto, a second ribbon spool mounted on the payout core, the second ribbon spool configured to move independent from the payout core, a takeup core including a first cylindrical core that rotates independent of a second cylindrical core, where the first cylindrical core is configure to receive a ribbon from the first ribbon spool and the second cylindrical core is configured to receive a ribbon from the second ribbon spool, and a first control mechanism configured to control a rotation of the second cylindrical core in a first direction, and a load applicator configured to control a rotation of the second ribbon spool.

DETAILED DESCRIPTION

Figure 1:
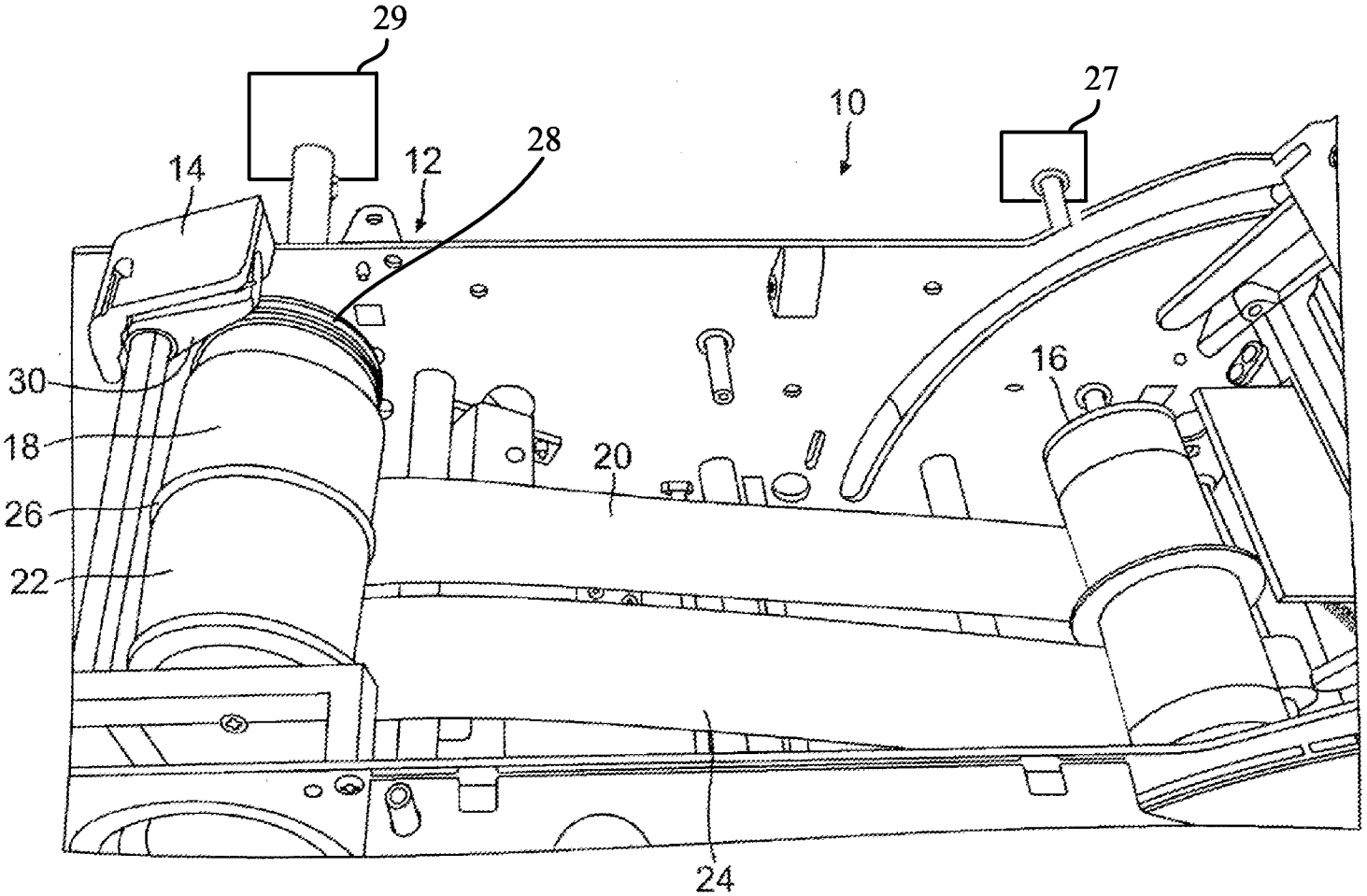
FIG. 1 is a perspective view of a credit card printer having a dual ribbon tension control assembly including a payout assembly with elastomeric o-rings, a load applicator assembly and a takeup assembly in accordance with one embodiment of the present invention.

Referring now to the drawings, embodiments of ribbon tension control assemblies that provide substantially constant tension to a ribbon are illustrated. In some embodiments, the ribbon tension control assemblies include a payout core having a cylindrical shape, a first ribbon spool mounted on and attached to the payout core, and a second ribbon spool mounted on the payout core, where the second ribbon spool is configured to move independent from the payout core. In such case, the ribbon tension control assemblies also include a takeup core configured to receive a ribbon from each of the first ribbon spool and second ribbon spool, and a load applicator configured to limit movement of the second ribbon spool, thereby maintaining substantially constant tension on both ribbons during operation.

In a number of embodiments, the tension control system includes a single drive source such as a drive motor for driving either the payout core or the takeup core. In other embodiments, the tension control system includes a drive motor for each of the payout core and the takeup core. In several embodiments, the tension control systems provide for substantially constant tension in multiple ribbons, and, as a result, the multiple ribbons effectively appear as a single ribbon medium for printing assemblies used in conjunction with the tension control systems.

In several embodiments, the load applicator is configured to make contact with an o-ring shaped elastomer positioned around the circumference of the second ribbon spool. In other embodiments, the load applicator is configured to make contact with a ring shaped braking disc positioned around the circumference of the second ribbon spool. In such case, the takeup core can include a first cylindrical core and a second cylindrical core where the first core rotates independently of the second core by way of a one way clutch.

Embodiments of tension control systems described herein can be extended to other media besides ribbons. For example, the tension control systems can be applied to other systems where media in two different panel thicknesses or two different spool diameters needs to be dispensed with substantially even tension using one drive system. In several embodiments, the tension control systems can be used with two or more ribbons or other suitable media that is intended to be dispensed substantially simultaneously using one drive system.

FIG. 1 is a perspective view of a credit card printer 10 having a dual ribbon tension control assembly including a payout assembly 12, a load applicator 14 and a takeup assembly 16 in accordance with one embodiment of the present invention. The dual ribbon tension control assembly includes the payout assembly 12, the load applicator 14, the takeup assembly 16, a silver ribbon spool 18 for a silver ribbon 20, and a black ribbon spool 22 for a black ribbon 24. The payout assembly 12 is mounted within a housing of the printer 10 and includes a payout core 26. The silver ribbon spool 18 and black ribbon spool 22 are mounted on the payout core 26. The silver ribbon spool 18 has a cylindrical shape and includes two elastomeric o-rings 28 that extend along a circumference of the cylindrical shape at an end of the silver ribbon spool 18.

In operation, a spring loaded arm 30 of the load applicator 14 applies pressure to the elastomers 28 such that a friction force opposes rotational motion of the silver ribbon spool 18 on the payout core 26. While the black ribbon spool 22 is generally attached to the payout core 26, the silver ribbon spool 18 can rotate free of the payout core 26. The movement of the silver ribbon 20 is therefore controlled by a takeup drive motor (depicted as block 27) attached to the takeup assembly 16. The load applicator 14 ensures that little or no loose slack exists in the silver ribbon 20 as it is drawn by takeup assembly 16. The movement of the black ribbon 24 is controlled by a payout drive motor (depicted as block 29) that controls rotation of the payout core 26 and/or the takeup drive motor 27.

In operation, the dual ribbon tension control assembly can effectively make the black and silver payout cores independent while providing substantially constant tension to the free floating silver payout core such that the assembly can handle ribbon spools having different outer diameters and ribbons of different thicknesses.

In one embodiment, the payout core 26 is made of a polymer such as Nylon 6/6, acrylonitrile butadiene styrene (ABS), or other suitable materials. In one embodiment, the takeup core is made of a polymer such as Nylon 6/6, Acrylonitrile butadiene styrene (ABS), polycarbonate, or other suitable materials. In the embodiment illustrated in FIG. 1, one ribbon spool provides a silver ribbon and the other ribbon spool provides a black color ribbon. In other embodiments, other ribbon colors can be used for the spools. In the embodiment illustrated in FIG. 1, the tension control assembly is a dual ribbon control assembly. In other embodiments, the tension control assembly can include more than two ribbon spools. In the embodiment illustrated in FIG. 1, the spools each include ribbons. In other embodiments, the spools can be used with other media where substantially constant tension for the media would be desirable.

Figure 2:
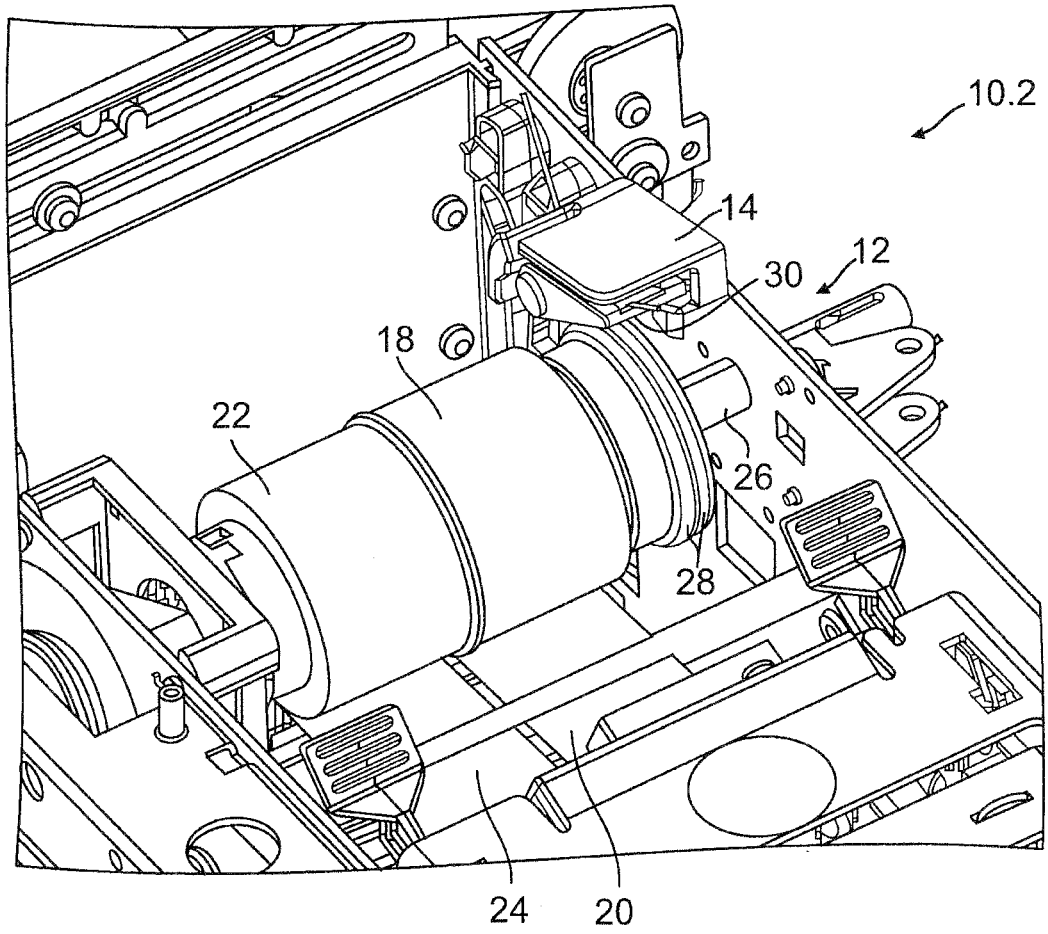
FIG. 2 is a perspective view of a credit card printer including the payout assembly of FIG. 1 in accordance with one embodiment of the present invention.

FIG. 2 is a perspective view of a credit card printer 10.2 including the payout assembly 12 of FIG. 1 in accordance with one embodiment of the present invention.

Figure 3:
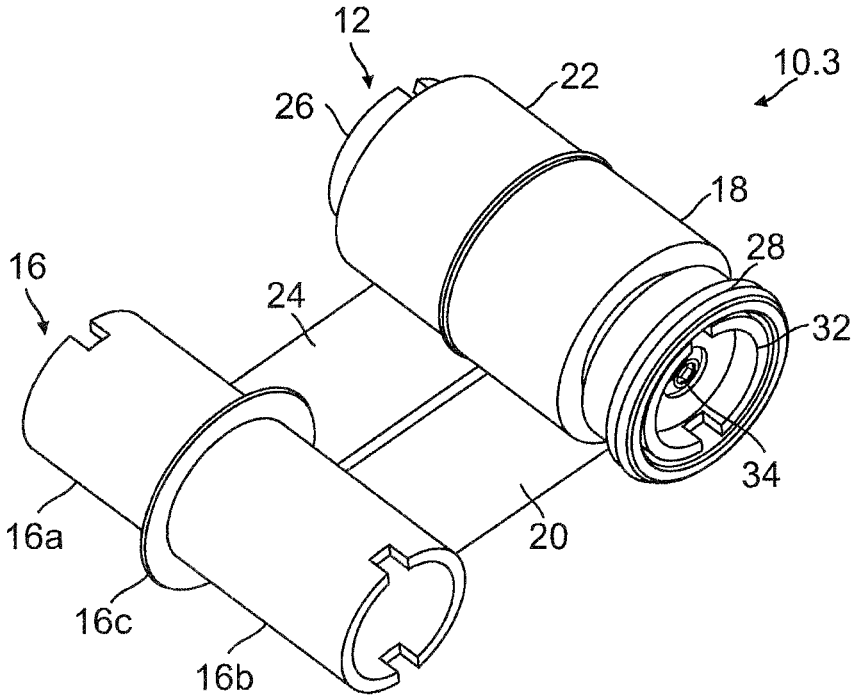
FIG. 3 is a perspective view of a dual ribbon tension control assembly including a payout assembly with elastomeric o-rings and a takeup assembly in accordance with one embodiment of the present invention.

FIG. 3 is a perspective view of a dual ribbon tension control assembly 10.3 including a payout assembly 12 and a takeup assembly 16 in accordance with one embodiment of the present invention. The payout assembly 12 is substantially similar to the corresponding assembly of FIG. 1 but further illustrates a ribbon spool plug 32 and a screw 34 for securing the plug to the payout core 26. The takeup assembly or core 16 includes a first core **16*a* for receiving the black ribbon 24, a second core 16*b* for receiving the silver ribbon 20, and a separator wall 16*c*** for keeping the ribbons separate.

Figure 4:
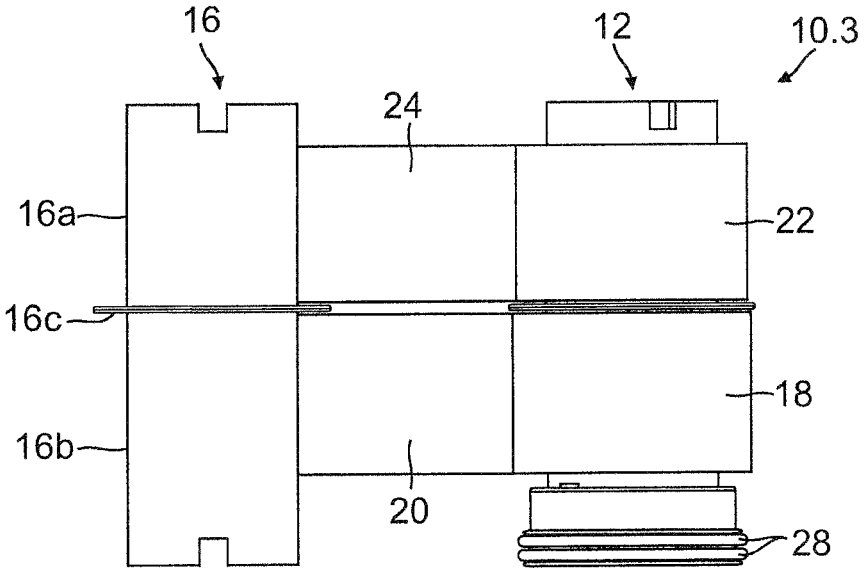
FIG. 4 is a top view of the dual ribbon tension control assembly of FIG. 3 in accordance with one embodiment of the present invention.

FIG. 4 is a top view of the dual ribbon tension control assembly 10.3 of FIG. 3 in accordance with one embodiment of the present invention.

Figure 5:
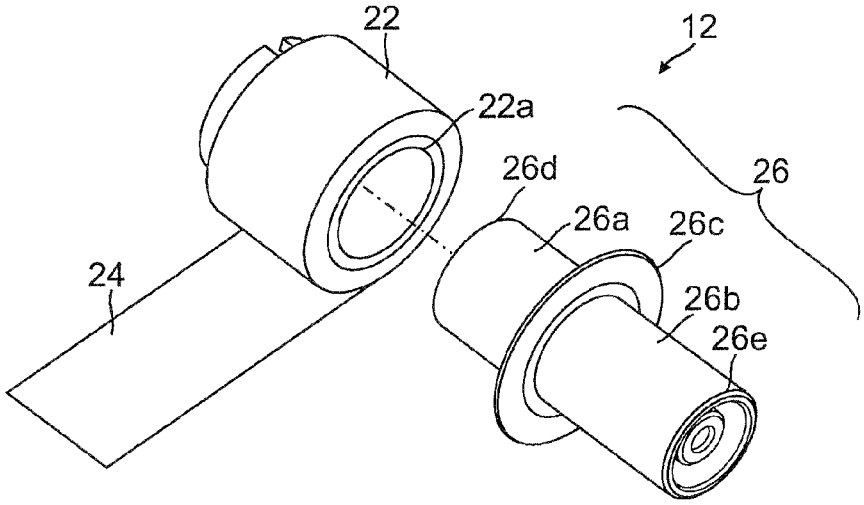
FIG. 5 is a perspective exploded view of a payout assembly including a dual payout core and a black ribbon supply spool in accordance with one embodiment of the present invention.

FIG. 5 is a perspective exploded view of a payout assembly 12 including a dual payout core 26 and a black ribbon supply spool 22 in accordance with one embodiment of the present invention. The dual payout core 26 includes a first core 26*a*, a second core 26*b* and a separator wall 26*c* for separating spools mounted on the cores. The first core 26*a* has an outer diameter of 26*d* and the second core 26*b* has an outer diameter of 26*e*. In a number of embodiments, the second core diameter 26*e* is less than the first core diameter 26*d*.

The black ribbon spool 22 is affixed to the first core 26*a* by use of a press or interference fit where an internal diameter of the black ribbon spool 22*a* is slightly less than the first core diameter 26*d*. In such case, the black ribbon spool 22 is forced onto the first core 26*a* and, in most embodiments, cannot move independent of the payout core 26.

Figure 6:
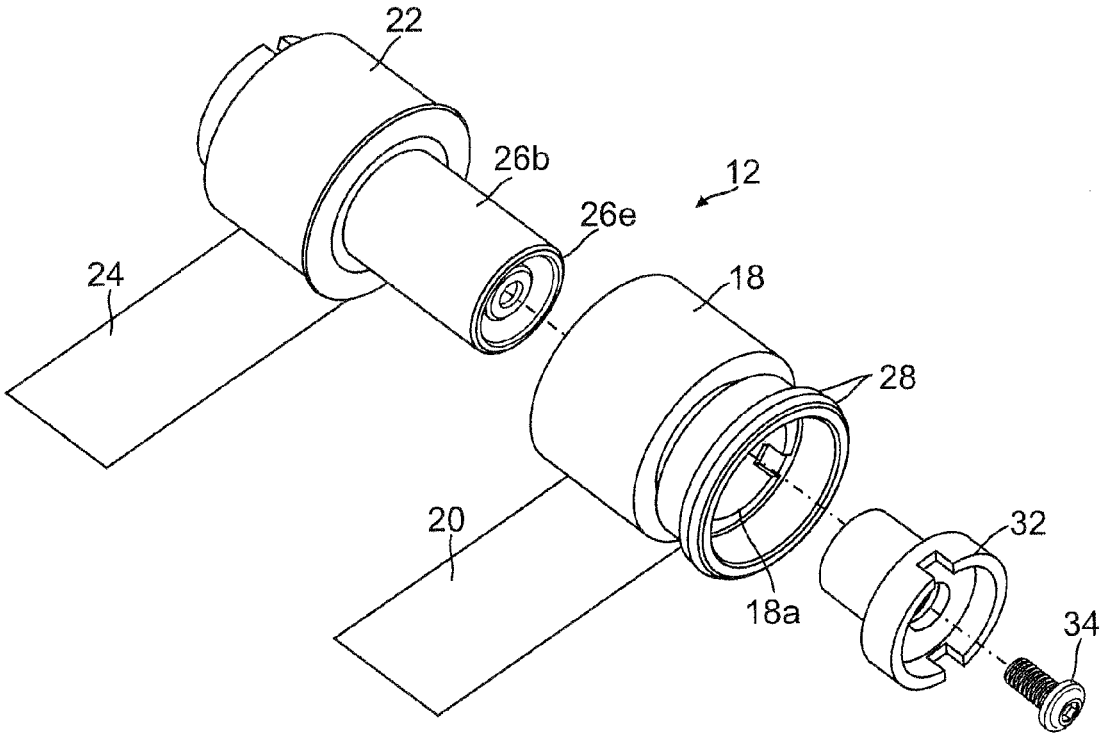
FIG. 6 is a perspective exploded view of the payout assembly of FIG. 5 further including a silver ribbon supply spool with elastomeric o-rings and a ribbon spool plug in accordance with one embodiment of the present invention.

FIG. 6 is a perspective exploded view of the payout assembly 12 of FIG. 5 further including the silver ribbon supply spool 18 and the ribbon spool plug 32 in accordance with one embodiment of the present invention. To install the silver ribbon supply spool 18, which will generally rotate freely around the second core 26*b* of the payout core 26, the silver ribbon supply spool 18 is slid onto the second core 26*b* and the ribbon spool plug 32 is affixed to the payout core 26 using screw 34. Thus, the ribbon spool plug 32 and separator wall 26*c* retain the silver ribbon supply spool 18 on the second core 26*b* of the payout core 26.

Figure 7:
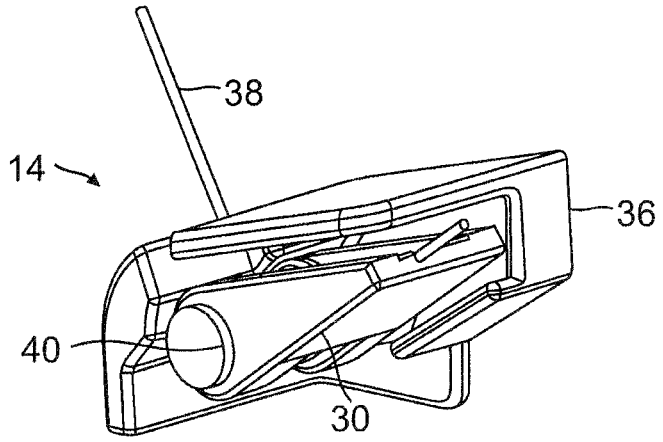
FIG. 7 is a perspective view of a load applicator assembly in accordance with one embodiment of the present invention.

FIG. 7 is a perspective view of a load applicator assembly 14 in accordance with one embodiment of the present invention. The load applicator assembly 14 includes a load applicator arm 30, a spring housing 36, a torsion spring 38, and a steel pin 40. The torsion spring 38 applies a force to the load applicator arm 30 with a friction pad 31 which rotates around steel pin 40 and can apply a force to an elastomeric o-ring such as those illustrated in FIGS. 1-2. In one embodiment, the load applicator assembly is made of a polymer such as Nylon 6/6 or other suitable materials. In one embodiment, the friction pad is made of stainless steel, galvanized steel, or other suitable materials.

Figure 8:
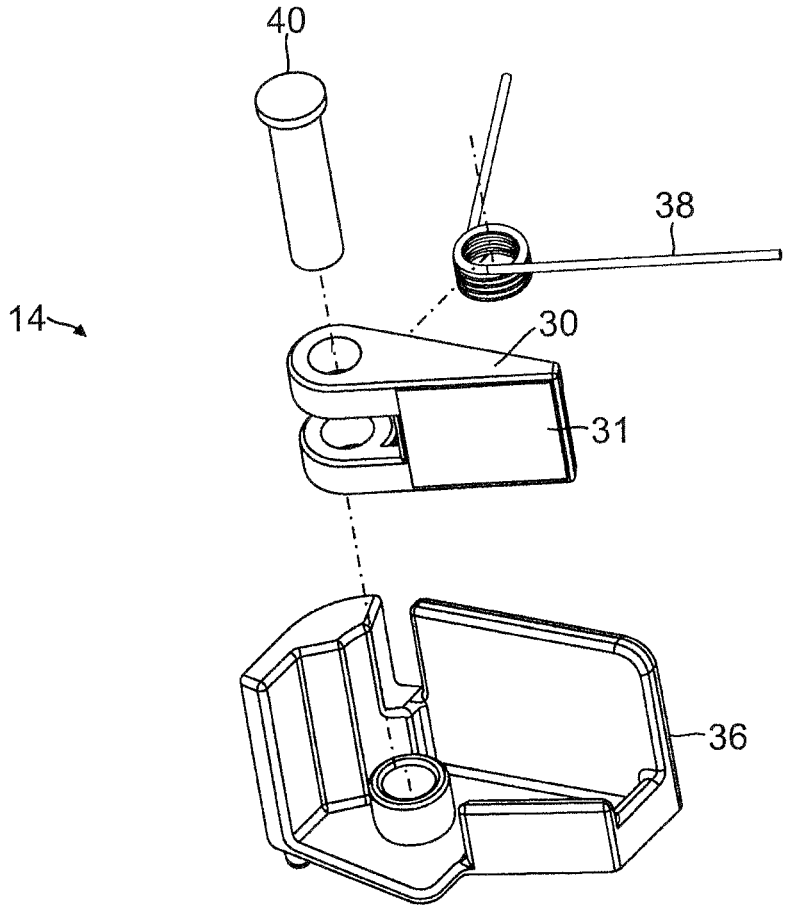
FIG. 8 is a perspective exploded view of the load applicator assembly of FIG. 7 in accordance with one embodiment of the present invention.

FIG. 8 is a perspective exploded view of the load applicator assembly 14 of FIG. 7 in accordance with one embodiment of the present invention.

Figure 9:
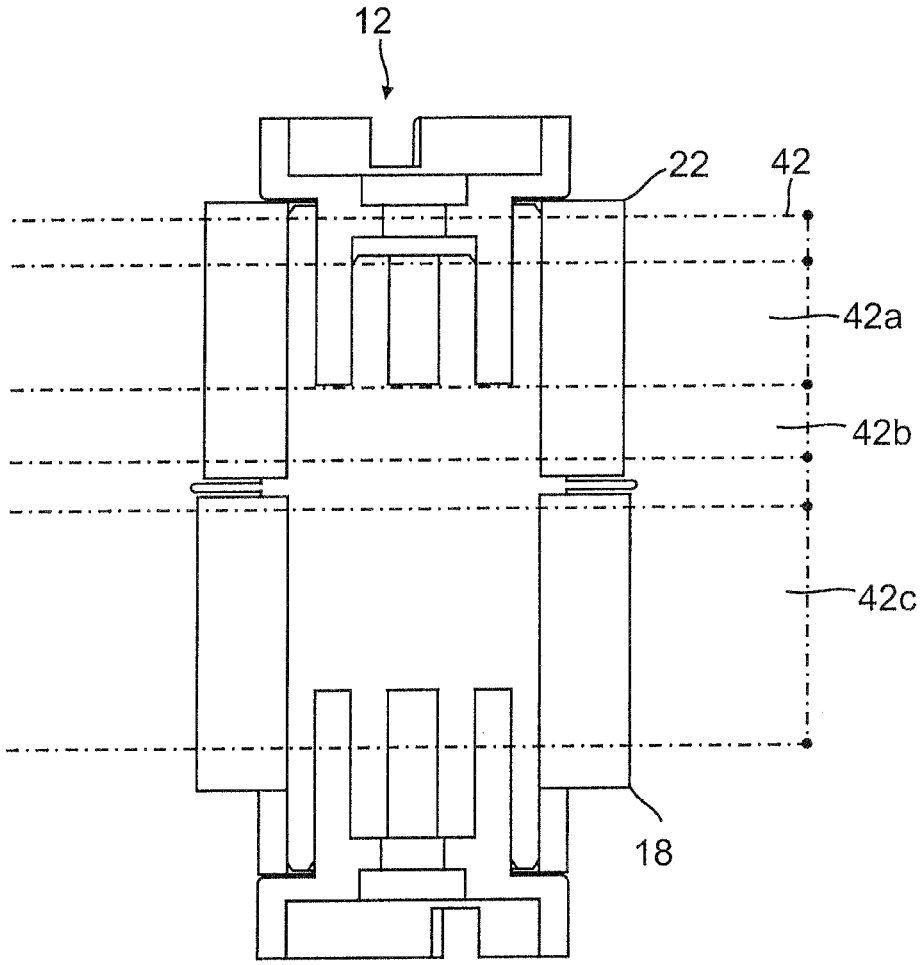
FIG. 9 is a top model view illustrating the physical relationship between a credit card and a payout assembly in a credit card printer in accordance with one embodiment of the present invention.

FIG. 9 is a top model view illustrating the physical relationship between a credit card 42 and a payout assembly 12 in a credit card printer in accordance with one embodiment of the present invention. The payout assembly 12 includes black and silver ribbon supply spools (22, 18). The black ribbon supply spool 22 is positioned over an area 42*b*, just below area 42*a* for the magnetic stripe, of the credit card 42 reserved for a signature panel and preselected text. The placement of the black ribbon of the black supply spool 22 allows the printer to print the preselected text including, for example, the last four digits of the credit card onto the signature panel and a 3 digit card verification value (CVV), also known as a card verification code (CVC), directly on to the plastic of the card adjacent to the signature panel (as in the case of a VISA or MasterCard credit card, which are trademarks of their respective trademark owners). The black ribbon may also be used to the print the complete credit card number on the signature panel (as in the case of an American Express or AMEX credit card, which are trademarks of their respective trademark owners).

The silver ribbon supply spool 18 is positioned over an area 42*c* defined by an ISO height limit of the credit card 42 reserved for embossed text. The placement of the silver ribbon spool 18 is such that it allows the printer to print the digits of the credit card number, expiration date, name and other information on the front of the credit card in the lower card area 42*c*. In many embodiments, a dual ribbon tension control assembly including the payout assembly can be used to print to both sides of a credit card without the need to reload or reconfigure the payout assembly with different spools.

Figure 10:
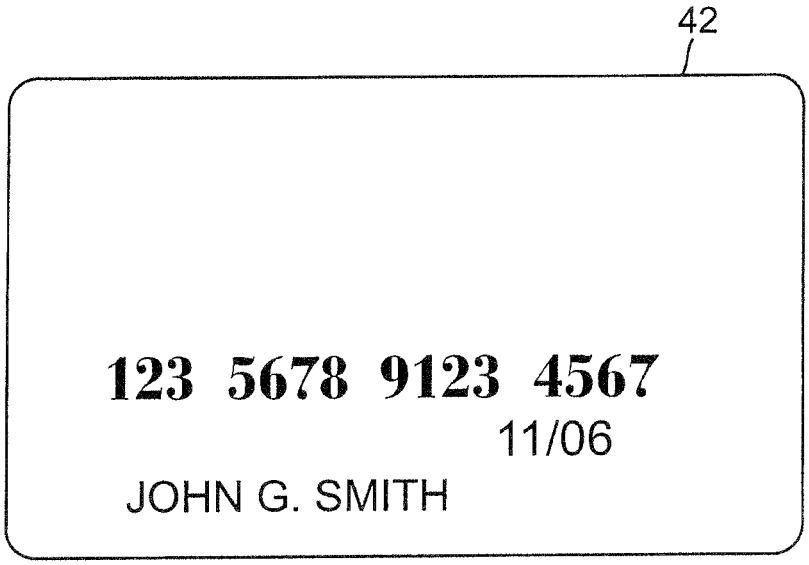
FIG. 10 is a top view of a top side of a credit card produced by a credit card printer including a dual ribbon tension control assembly in accordance with one embodiment of the present invention.

FIG. 10 is a top view of a top side of a credit card 42 produced by a credit card printer including a dual ribbon tension control assembly in accordance with one embodiment of the present invention. The credit card 42 includes text that was printed using a silver ribbon supply spool and a dual ribbon tension control assembly in accordance with one of the embodiments described above.

Figure 11:
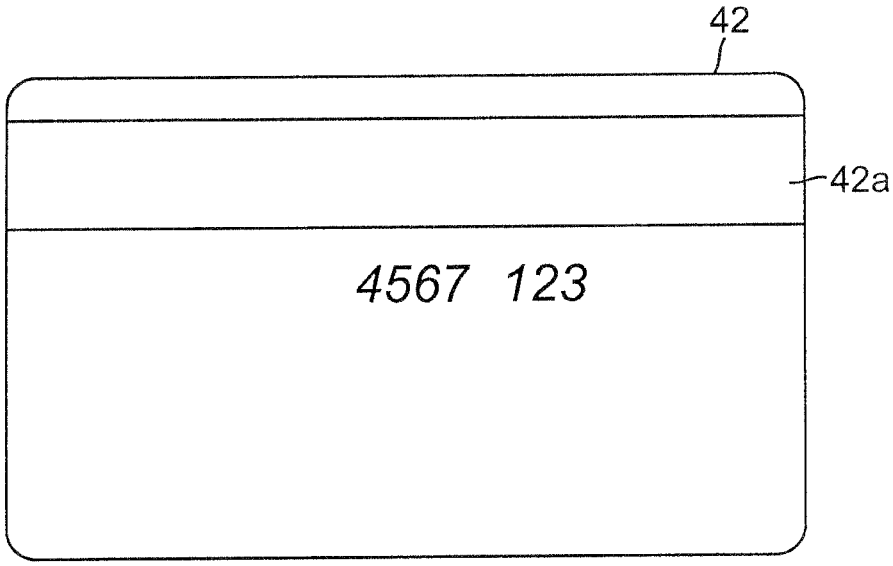
FIG. 11 is a top view of a bottom side of the credit card of FIG. 10.

FIG. 11 is a top view of a bottom side of the credit card 42 of FIG. 10. The credit card 42 includes the magnetic stripe 42*a* and additional text that was printed using a black ribbon supply spool and a dual ribbon tension control assembly in accordance with one of the embodiments described above.

In one embodiment, the load is applied directly to the outer diameter of the silver ribbon supply spool. The tension on the spool is maintained substantially constant by using a torsion spring in series with an extension spring. One leg of the torsion spring can apply load force to the ribbon spool while the other leg of the torsion spring can be pulled to an angle using the extension spring. As the silver supply spool pays out and becomes smaller in diameter, the extension spring pulling on the torsion spring ensures that the load force applied remains substantially constant.

Figure 12:
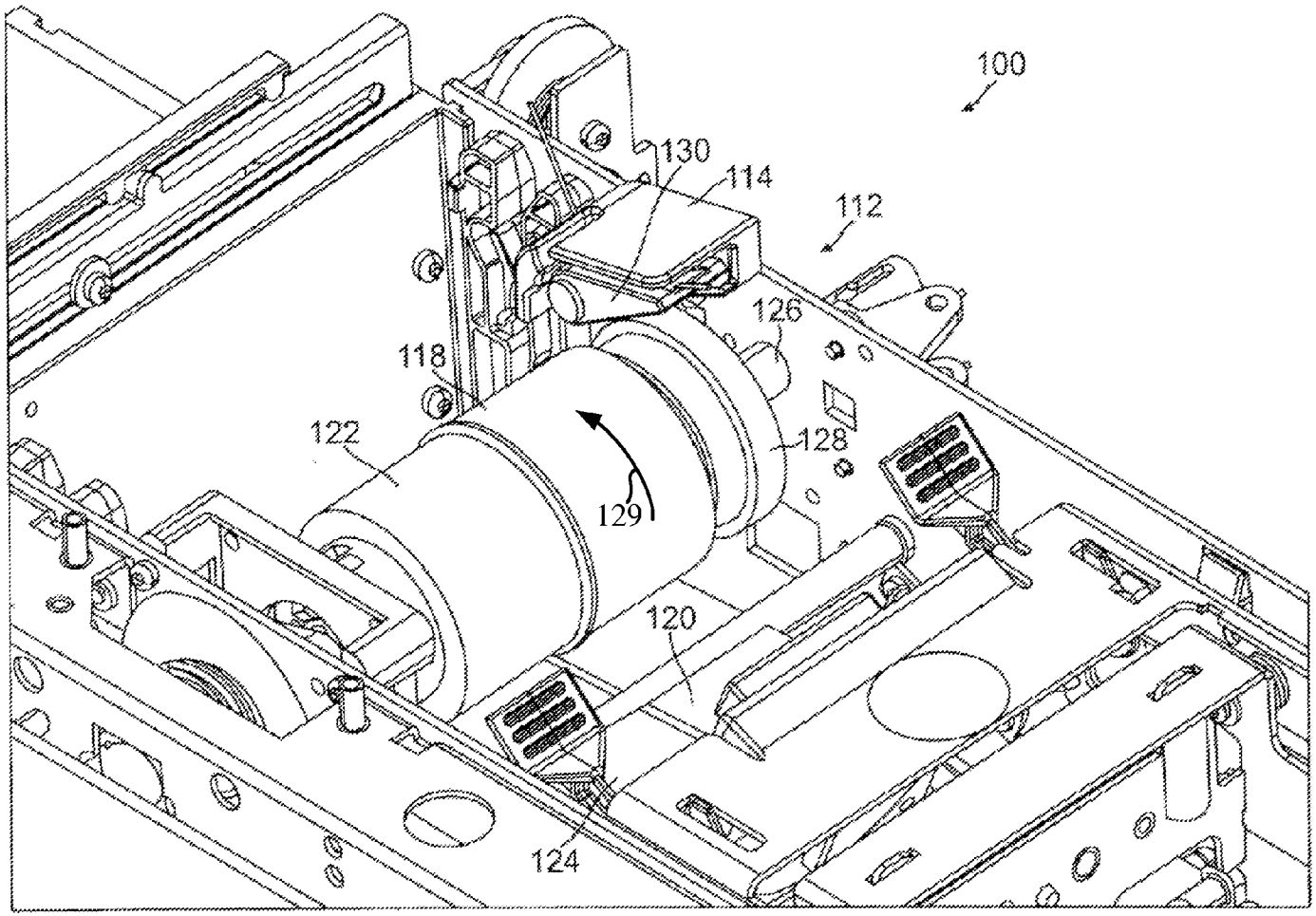
FIG. 12 is a perspective view of a credit card printer having a dual ribbon tension control assembly including a payout assembly with a braking disc, a load applicator assembly and a takeup assembly with a one-way clutch (not shown) in accordance with another embodiment of the present invention.

FIG. 12 is a perspective view of a credit card printer 100 having a dual ribbon tension control assembly including a payout assembly 112 with a braking disc 128, a load applicator assembly 114 and a takeup assembly with a one-way clutch (not shown) in accordance with another embodiment of the present invention.

The dual ribbon tension control assembly includes the payout assembly 112, the load applicator 114, the takeup assembly (not shown), a silver ribbon spool 118 for a silver ribbon 120, and a black ribbon spool 122 for a black ribbon 124. The payout assembly 112 is mounted within a housing of the printer 100 and includes a payout core 126. The silver ribbon spool 118 and black ribbon spool 122 are mounted on the payout core 126. The silver ribbon spool 118 has a cylindrical shape and includes a braking disc 128 having a ring shape that extends along a circumference of the cylindrical shape at an end of the silver ribbon spool 118.

In operation, a spring loaded arm 130 of the load applicator 114 applies pressure to the braking disc 128 such that a friction force opposes rotational motion, or motion in the direction of ribbon payout (e.g., the first direction 129), of the silver ribbon spool 118 on the payout core 126. While the black ribbon spool 122 is generally attached to the payout core 126, the silver ribbon spool 118 can rotate free of the payout core 126. The movement of the silver ribbon 120 is therefore controlled by a takeup drive motor (not shown) attached to the takeup assembly (see FIG. 13). The load applicator 114 ensures that little or no loose slack exists in the silver ribbon 120 as it is drawn by takeup assembly. In addition, the takeup core includes a one-way clutch for the silver ribbon 120. In such case, the silver ribbon 120 on the takeup core moves with the black ribbon 124 in the payout direction but spins freely and therefore remains substantially fixed in position while the black ribbon 124 is reversed during operation. The movement of the black ribbon 124 is controlled by a payout drive motor (not shown) that controls rotation of the payout core 126 and/or the takeup drive motor (not shown).

In one embodiment, the braking disc is made of a metal such as steel. In other embodiments, the braking disc can be made of other suitable materials.

Figure 13:
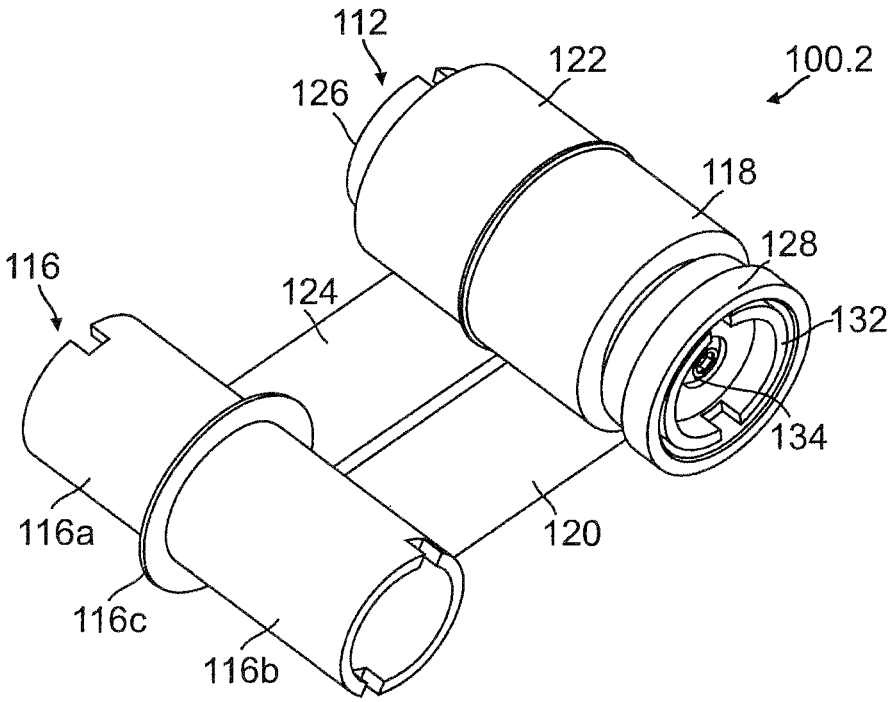
FIG. 13 is a perspective view of a dual ribbon tension control assembly including a payout assembly with a braking disc and a takeup assembly including a black takeup core and a silver take core with a one-way clutch in accordance with one embodiment of the present invention.

FIG. 13 is a perspective view of a dual ribbon tension control assembly 100.2 including a payout assembly 112 with a braking disc 128 and a takeup assembly 116 including a black takeup core 116*a* and a silver take core 116*b* with a one-way clutch (not visible) in accordance with one embodiment of the present invention. The payout assembly 112 is substantially similar to the corresponding assembly of FIG. 12 but further illustrates a ribbon spool plug 132 and a screw 134 for securing the plug to the payout core 126. The takeup assembly or core 116 further includes the black core 116*a* for receiving the black ribbon 124, a silver core 116*b* for receiving the silver ribbon 20, and a separator wall 116*c* for separating the black and silver ribbons.

Figure 14:
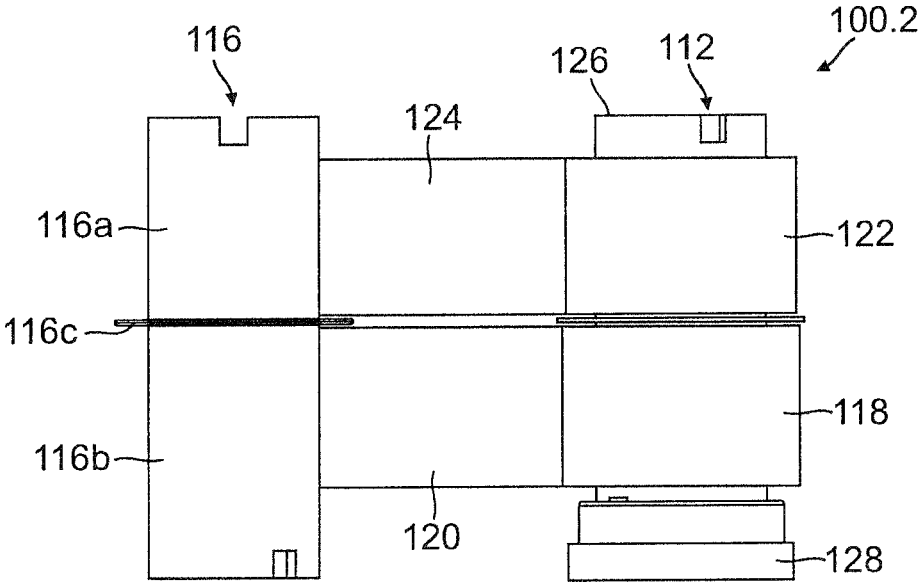
FIG. 14 is a top view of the dual ribbon tension control assembly of FIG. 13 in accordance with one embodiment of the present invention.

FIG. 14 is a top view of the dual ribbon tension control assembly 100.2 of FIG. 13 in accordance with one embodiment of the present invention.

Figure 15:
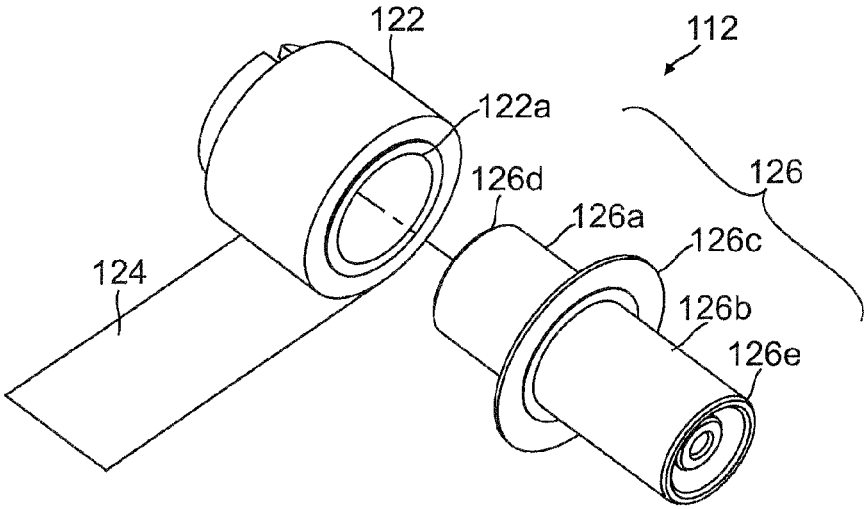
FIG. 15 is a perspective exploded view of a payout assembly including a dual payout core and a black ribbon supply spool in accordance with one embodiment of the present invention.

FIG. 15 is a perspective exploded view of a payout assembly 112 including a dual payout core 126 and a black ribbon supply spool 122 in accordance with one embodiment of the present invention. The dual payout core 126 includes a first core 126*a*, a second core 126*b* and a separator wall 126*c* for separating spools mounted on the cores. The first core 126*a* has an outer diameter of 126*d* and the second core 126*b* has an outer diameter of 126*e*. In a number of embodiments, the second core diameter 126*e* is less than the first core diameter 126*d*.

The black ribbon spool 122 is affixed to the first core 126*a* by use of a press or interference fit where an internal diameter of the black ribbon spool 122*a* is slightly less than the first core diameter 126*d*. In such case, the black ribbon spool 122 is forced onto the first core 126*a* and, in most embodiments, cannot move independent of the payout core 126.

Figure 16:
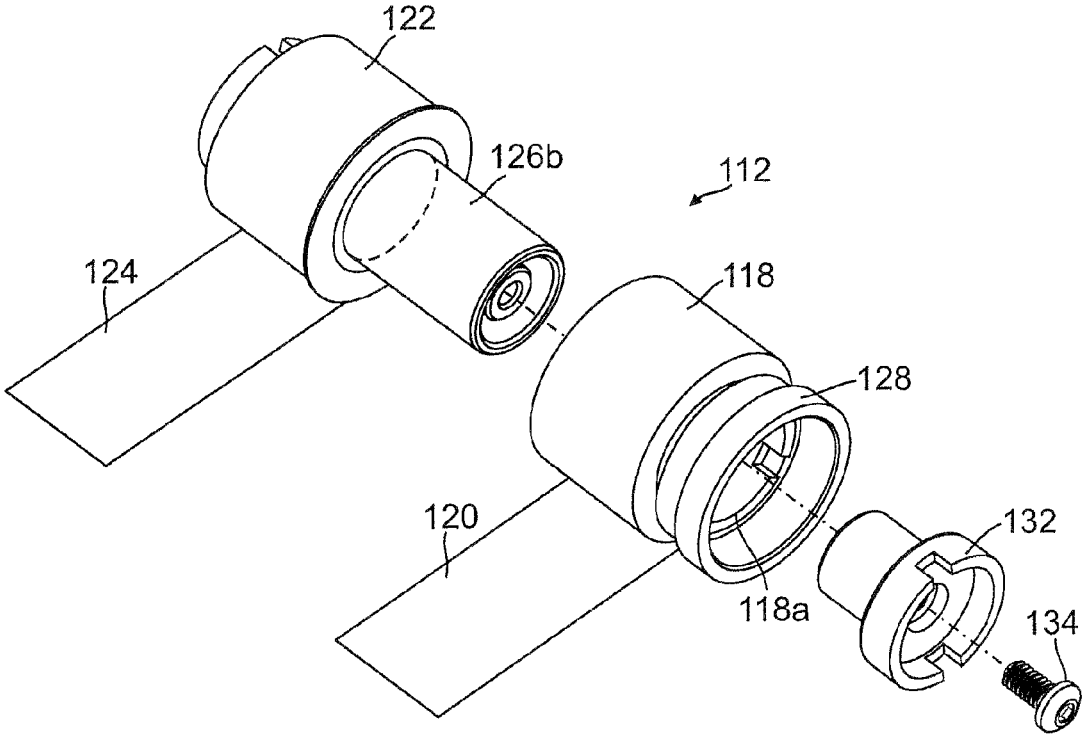
FIG. 16 is a perspective exploded view of the payout assembly of FIG. 15 further including a silver ribbon supply spool with a braking disc and a ribbon spool plug in accordance with one embodiment of the present invention.

FIG. 16 is a perspective exploded view of the payout assembly 112 of FIG. 15 further including a silver ribbon supply spool 118 with a braking disc 128 and a ribbon spool plug 132 in accordance with one embodiment of the present invention. To install the silver ribbon supply spool 118, which will generally rotate freely around the second core 126*b* of the payout core 126, the silver ribbon supply spool 118 is slid onto the second core 126*b* and the ribbon spool plug 132 is affixed to the payout core 126 using screw 134. Thus, the ribbon spool plug 132 and separator wall 126*c* retain the silver ribbon supply spool 118 on the second core 126*b* of the payout core 126.

Figure 17:
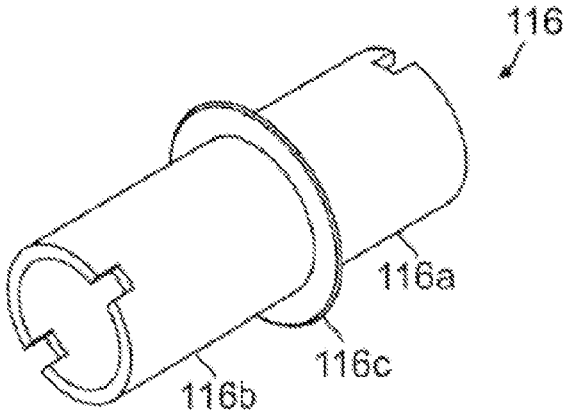
FIG. 17 is a perspective view of a takeup assembly including a black takeup core and a silver take core with a one-way clutch in accordance with one embodiment of the present invention.

FIG. 17 is a perspective view of a takeup assembly 116 including a black takeup core 116*a* and a silver take core 116*b* with a one-way clutch (not visible) in accordance with one embodiment of the present invention. The takeup assembly 116 further includes the separator wall 116*c* for separating the black and silver ribbons.

Figure 18:
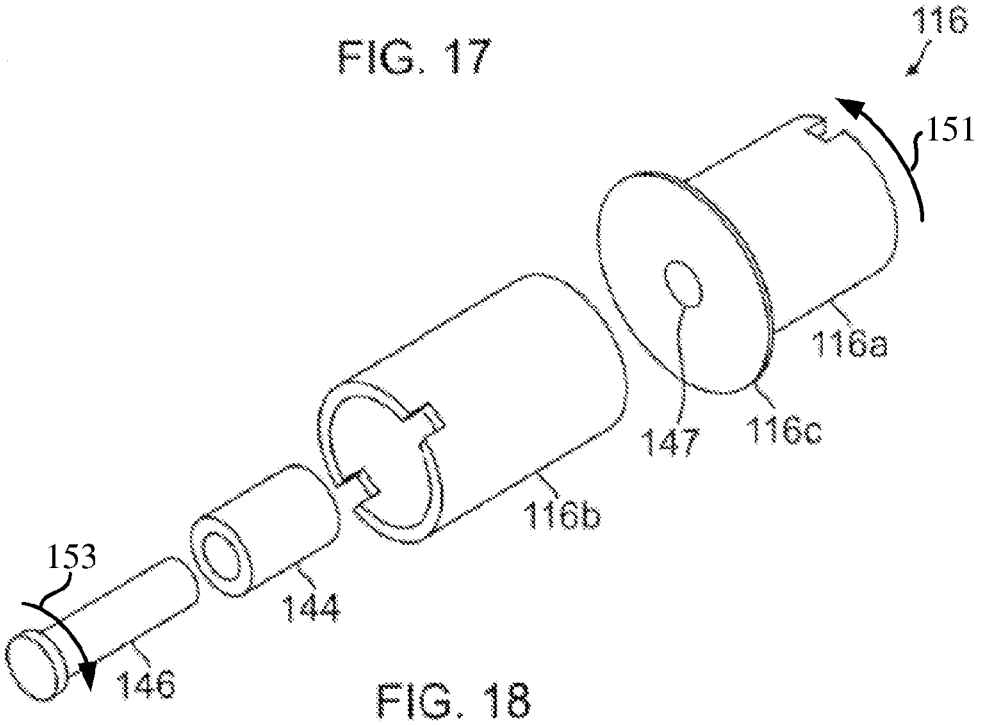
FIG. 18 is a perspective exploded view of the silver takeup core and one-way clutch of the takeup assembly of FIG. 17 in accordance with one embodiment of the present invention.
Figure 19:
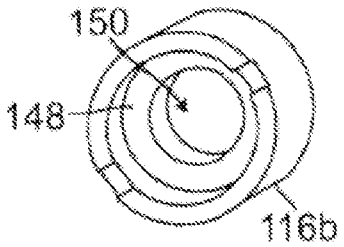
FIG. 19 is a perspective view of the silver takeup core of FIGS. 17 and 18 in accordance with one embodiment of the present invention.

FIG. 18 is a perspective exploded view of the silver takeup core 116*b* and one-way clutch 144 of the takeup assembly 116 of FIG. 17 in accordance with one embodiment of the present invention. FIG. 19 is a perspective view of the silver takeup core 116*b* of FIGS. 17 and 18 in accordance with one embodiment of the present invention.

Referring now to FIGS. 18 and 19, the takeup assembly 116 includes the silver takeup core 116*b*, the one-way roller clutch 144 and a steel pin 146. The one-way roller clutch 144 is press fit into an opening 150 of a inner cylindrical wall 148 of the silver takeup core 116*b*. The steel pin 146 is press fit into an opening 147 of the black takeup core 116*a*. In such case, the silver takeup core 116*b* is free to rotate in first direction 151 with the black takeup core 116*a*. The one way roller clutch 144 however prevents rotational motion in a second direction 153 opposite to the first direction 151. In one embodiment, the one way roller clutch is a unidirectional rolling clutch provided by Stock Drive Products/Sterling Instrument of New Hyde Park, N.Y. However, one way roller clutches are known in the art and any number of those may be suitable for use in the takeup assembly 116.

Figure 20:
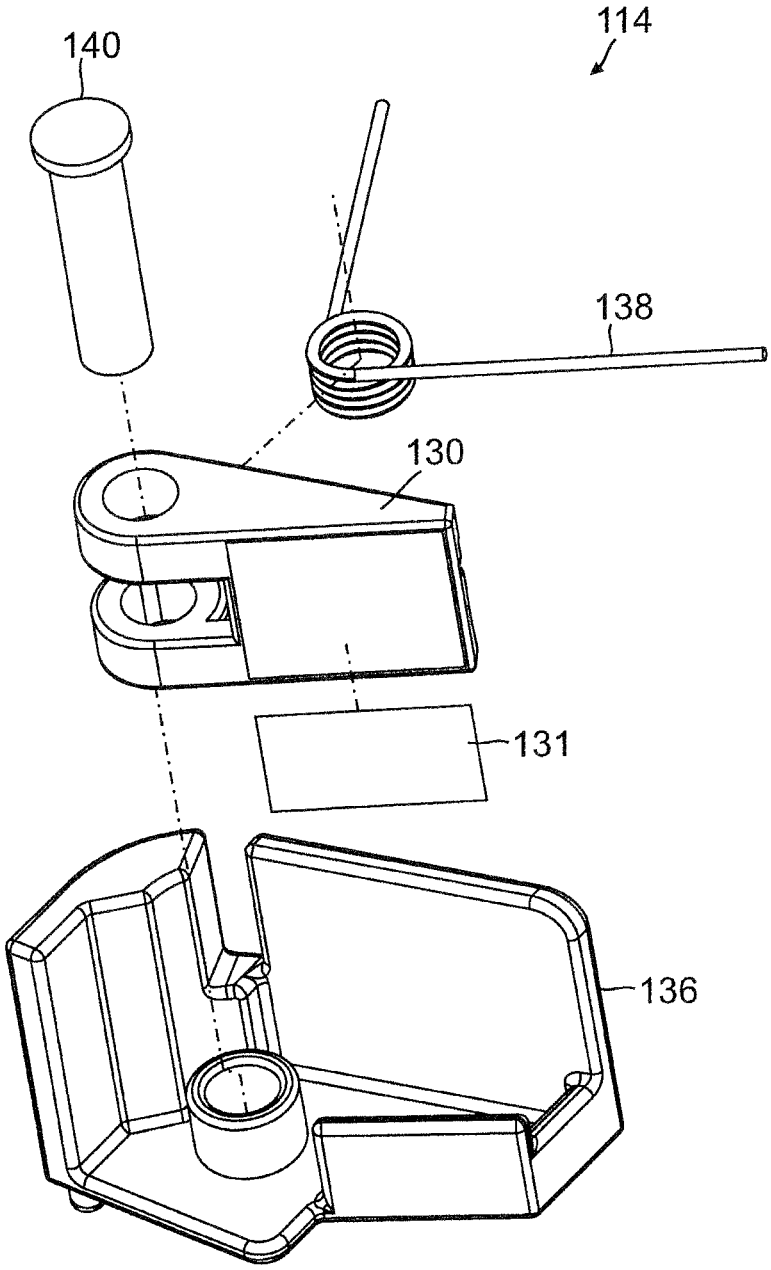
FIG. 20 is a perspective exploded view of a load applicator assembly in accordance with one embodiment of the present invention.

FIG. 20 is a perspective exploded view of a load applicator assembly 114 in accordance with one embodiment of the present invention. The load applicator assembly 114 includes a load applicator arm 130, a spring housing 136, a torsion spring 138, and a steel pin 140. The torsion spring 138 applies a force to the load applicator arm 130 which rotates around steel pin 140 and can apply a force to a braking disc such as the one illustrated in FIG. 12. A friction insert pad 131 is affixed to the load applicator arm 130 to provide the frictional force to oppose motion of silver payout core having the braking disc. In one embodiment, the friction pad insert is made of polyurethane rubber, silicone rubber, or another suitable material.

In another embodiment, the load/friction force on the silver supply spool can be applied using magnetic resistance. In such case, a bi-metal disc made of a steel core with a copper layer around it is attached to, and extends around a circumference of, the silver supply spool. A series of magnets can be placed in a semi-circular arc positioned proximate yet radially beyond the bi-metal disc. The use of magnetic resistance as a load/friction force in this embodiment is similar to the use of magnetic resistance in stationary bicycles.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

In several of the embodiments described herein, the tension control system is used in conjunction with ribbon spooling systems for printing. In other embodiments, the tension control system can be used with cable spooling systems or other systems having media wound on one or more spools.

What is claimed is:

1. A ribbon tension control assembly for maintaining substantially constant tension in two ribbons dispensing from a common payout core, the assembly comprising:

a payout core having a cylindrical shape;

a first ribbon spool mounted on the payout core and attached thereto;

a second ribbon spool mounted on the payout core, the second ribbon spool configured to move independent from the payout core;

a takeup core configured to receive a ribbon from each of the first ribbon spool and second ribbon spool; and a load applicator configured to limit movement of the second ribbon spool.

2. The ribbon tension control assembly of claim 1, further comprising an elastomer comprising an o-ring shape, wherein in the elastomer is positioned around a circumference of the second ribbon spool.

3. The ribbon tension control assembly of claim 2, wherein the load applicator comprises a spring loaded arm configured to contact the elastomer.

4. The ribbon tension control assembly of claim 3:

wherein the second ribbon spool is configured to rotate around the payout core in a first direction and a second direction opposite to the first direction; and wherein the load applicator is configured to restrict movement of the second ribbon spool in the first direction when the spring loaded arm is in contact with the elastomer.

5. The ribbon tension control assembly of claim 1:

wherein the first ribbon spool comprises a first diameter; and wherein the second ribbon spool comprises a second diameter not equal to the first diameter.

6. The ribbon tension control assembly of claim 1, wherein the payout core comprises a spool plug for retaining the second ribbon spool on the payout core.

7. The ribbon tension control assembly of claim 1, wherein the first ribbon spool is attached to the payout core using a press fit.

8. The ribbon tension control assembly of claim 1, further comprising:

a drive motor configured to drive both the payout core and the takeup core.

9. The ribbon tension control assembly of claim 1, further comprising:

a payout drive motor coupled to the payout core; and a takeup drive motor coupled to the takeup core.

10. The ribbon tension control assembly of claim 1, wherein the ribbon tension control assembly is used within a printer configured to print to credit card stock.

11. The ribbon tension control assembly of claim 10:

wherein the printer comprises a print head; and wherein the ribbons from each of the first and second ribbon spools are configured to pass between the print head and a credit card from the credit card stock.

12. The ribbon tension control assembly of claim 1, wherein the first ribbon spool comprises a black ribbon and the second ribbon spool comprises a silver ribbon.

13. A ribbon tension control assembly for maintaining substantially constant tension in two ribbons dispensing from a common payout core, the assembly comprising:

a payout core having a cylindrical shape;

a first ribbon spool mounted on the payout core and attached thereto;

a second ribbon spool mounted on the payout core, the second ribbon spool configured to move independent from the payout core;

a takeup core comprising:

a first cylindrical core that rotates independent of a second cylindrical core, wherein the first cylindrical core is configured to receive a ribbon from the first ribbon spool and the second cylindrical core is configured to receive a ribbon from the second ribbon spool; and a first control mechanism configured to control a rotation of the second cylindrical core in a direction; and a load applicator configured to control a rotation of the second ribbon spool.

14. The ribbon tension control assembly of claim 13, wherein the first control mechanism is a clutch.

15. The ribbon tension control assembly of claim 14, wherein the clutch prevents rotation of the second cylindrical core in the first direction.

16. The ribbon tension control assembly of claim 15, wherein the clutch allows rotation of the second cylindrical core in another direction opposite to the direction.

17. The ribbon tension control assembly of claim 13, wherein the load applicator is a brake.

18. The ribbon tension control assembly of claim 17:

wherein the second ribbon spool comprises a ring shaped disc fixed to the second ribbon spool; and wherein the brake comprises an arm configured to contact the disc and impart a frictional force thereon.

19. The ribbon tension control assembly of claim 13, further comprising:

a drive motor configured to drive both the payout core and the takeup core.

* * * * *